US006230349B1

(12) United States Patent
Silver et al.

(10) Patent No.: US 6,230,349 B1
(45) Date of Patent: May 15, 2001

(54) TRAVEL PILLOW

(76) Inventors: Abbye M. Silver, 2425 Ridgewood Dr., Waco, TX (US) 76710; Jeffrey M. Wolf, 3510 N. Ridge Rd., Waco, TX (US) 76710

( * ) Notice: Subject to any disclaimer, the term of this patent is extended or adjusted under 35 U.S.C. 154(b) by 0 days.

(21) Appl. No.: 09/564,291

(22) Filed: May 3, 2000

(51) Int. Cl.[7] ..... A47G 9/00
(52) U.S. Cl. ..... 5/636; 297/393
(58) Field of Search ..... 5/636, 644, 490, 5/911; 297/393, 391

(56) References Cited

U.S. PATENT DOCUMENTS

| | | | | |
|---|---|---|---|---|
| 98,859 | | 1/1870 | Fast | 297/393 |
| 1,212,515 | * | 1/1917 | Leavitt | 5/636 |
| 1,349,258 | * | 8/1920 | Blocksom | 5/490 |
| 2,336,707 | | 12/1943 | Thompson . | |
| 2,522,120 | * | 9/1950 | Kaskby et al. | 5/644 |
| 3,241,161 | * | 3/1966 | Dashosm | 5/490 |
| 3,327,330 | | 6/1967 | McCullough . | |
| 4,060,863 | | 12/1977 | Craig . | |
| 4,139,920 | * | 2/1979 | Evans | 5/911 |
| 4,345,347 | | 8/1982 | Kantor . | |
| 4,679,262 | | 7/1987 | Davis . | |
| 4,783,866 | * | 11/1988 | Simmons et al. | 5/421 |
| 6,009,577 | | 1/2000 | Day | 5/636 |

FOREIGN PATENT DOCUMENTS

| | | | | |
|---|---|---|---|---|
| 838455 | * | 6/1960 | (GB) | 297/393 |

* cited by examiner

*Primary Examiner*—Alexander Grosz
(74) *Attorney, Agent, or Firm*—Sherman D. Pernia

(57) ABSTRACT

A travel pillow is disclosed, having a compact size and a U-shape for cradling the head and neck of a user while sitting in repose in a high backed chair or seat. The travel pillow comprises a casing stuffed with a fill material, and an opening in the casing allowing the user to add or remove fill material in order to adjust the firmness of the pillow. The fill material is biologically inert and the travel pillow is completely washable. The pillow's casing is constructed of two similarly sized fabric members, one of which has the opening in it. When filled, the travel pillow has a substantially uniform cross section through most of the pillow's U-shape.

11 Claims, 3 Drawing Sheets

TRAVEL PILLOW

BACKGROUND OF THE INVENTION

The field has long been motivated to provide pillows for use when a person is sitting in repose. For example, over a century and a quarter ago Fast (U.S. Pat. No. 98,859) disclosed a device for supporting the head and upper spine of a user. The Fast device consists of a combination of an air-cushion placed at the back of a user's neck and two arm straps. The arm straps are tied to the user's arms and utilizes their weight as a counter-balance to assist in the support of the user's head. However, this combination encumbers a user's arms in order to accomplish its utility.

Later efforts in the field include the Thompson device (U.S. Pat. No. 2,336,707), which discloses a cradle-shaped pillow having a plurality of interior compartments, and a smaller-sized section for receiving the back of a user's neck. Kantor (U.S. Pat. No. 4,345,347) also discloses a head/neck cushion with a depressed section for receiving the back of a user's head. In contrast, Craig (U.S. Pat. No. 4,060,863) discloses a V-shaped pillow that increases in width toward the apex of the V-shape where the back of the user's neck is received. Davis et al. disclose a relatively stiff cushion for receiving only one side of a user's neck These prior devices employ various structural elements and features in order to accomplish their utility. However, none of these cushion/pillow devices disclose or teach the use of a solid fill material which the user can insert or remove in order to either modify the firmness of the pillow, or to allow washing of the casing and replacement of the fill material. It would be beneficial to have a travel pillow for use when sitting in repose which combines simplicity of construction with the ability to adjust firmness and easily be cleaned.

SUMMARY OF THE INVENTION

The present invention is a travel pillow having a compact size and a U-shape for cradling the head and neck of a user while sitting in repose. The crotch of the U-shaped pillow fits around the user's neck sufficiently closely to hold the pillow in position. The travel pillow is particularly useful for supporting the head and neck of the user while sitting in an upright or semi-reclining position in a high-backed chair, such as those on an airplane, automobile, bus, or the like. Because the pillow has a substantially-uniform cross section, the pillow provides comforting support in a variety of head positions while the user is in repose.

The travel pillow comprises a U-shaped pillow body containing a fill material, and having a substantially uniform cross section around the U-shape of the pillow body. The two legs of the U-shaped body form a crotch between them and where they join at the base of the U-shape. The crotch defined by the two legs and the base of the U-shape is configured to receive the neck of a user sufficiently closely to hold the pillow body in position while in use. The present travel pillow utilizes a solid fill material (as opposed to being filled with air) to provide the substantially uniform cross section of the pillow body, and a closeable opening for adding or removing fill material.

The body of the travel pillow comprises a casing stuffed with a fill material. The casing defines the exterior surface of the pillow body. The interior surface of the casing defines the lumen or interior space of the pillow body. The lumen is a single, continuous interior compartment which contains the fill material of the pillow body. The casing comprises two fabric members of substantially the same size and shape.

The fabric members of the casing typically are constructed of a washable, woven or knitted material. Materials suitable for practicing the fabric casing include man-made fibers, natural fibers, and combinations thereof, further including cottons, poly/cottons, fleeces, wools, flannels, etc.

The fabric members each have a perimeter edge and a horse-shoe or U-shape. The two fabric members contact and are connected to each other at their perimeter edges by a seam around their perimeter edges. The seam may be sewn together or sealed together in some other fashion compatible with the type of fabric involved. For example, some fabrics may be heat sealed together, while others may be glued. An appropriate fabric and method of connecting the perimeter seams of the members together is selectable by the ordinary skilled artisan.

One of the fabric casing members has a closeable opening set into it, the opening being removed from the perimeter edge of the fabric member. The opening is located on the fabric member along a chord removed from the perimeter edge in the crotch section of the horseshoe or U-shaped fabric member. The opening of the fabric member is made reversibly closeable by any of a number of means known to one of ordinary skill in the art, including zipper closures, buttons or snaps, hook-and-loop fasteners, laces, etc. The opening and the means for opening and closing the opening is covered with a fly.

The lumen of the pillow body casing is a single, continuous interior compartment. The lumen is packed with a sufficient amount of fill material to provide the substantially uniform cross section around the U-shape of the body. The fill material can be any of a variety of fibrous or fluent materials selectable by the ordinary skilled artisan for stuffing in a pillow. It is intended that the fill material be biologically inert to reduce the opportunity for the growth of germs, molds or fungi on the fill material. Also, it is intended that the fill material be washable and/or replaceable by the user. Appropriate biologically inert fill materials include polystyrene, polyester, and similar man-made materials.

DETAILED DESCRIPTION OF THE INVENTION

Figure 1:
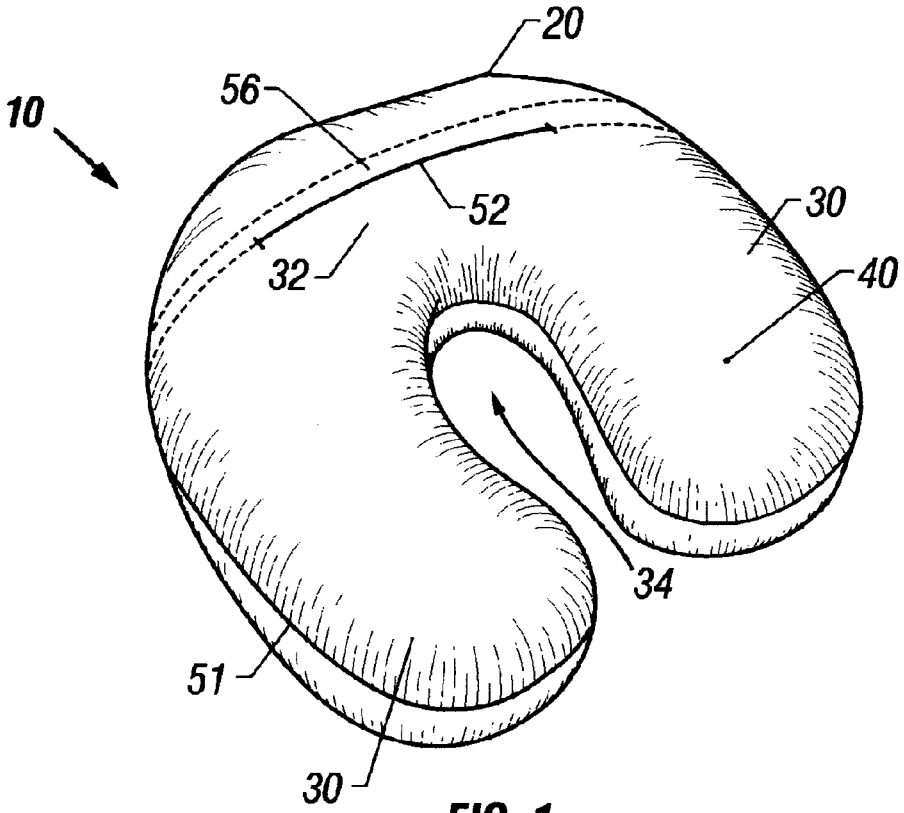
FIG. 1 is a perspective view of the travel pillow of the present invention.

Referring now to the drawings, the details of preferred embodiments of the present invention are graphically and schematically illustrated. Like elements in the drawings will be represented by like numbers.

As shown in FIG. 1, the travel pillow 10 is of a compact size and is configured in a horseshoe or U-shape, for receiving and cradling the neck and head of a user. The travel pillow comprises a pillow body 20 configured in a U-shape. The cross section has a length L that is substantially uniform around the U-shape of the pillow body 20 (see FIG. 2) until proximate the ends of the legs 30. The U-shape pillow body 20 has two legs 30 and a base 32. The two legs 30 join the base 32 and form a crotch 34 between them and where they join the base 32. The crotch 34 is a space defined by the exterior surface 42 of the pillow body between the legs 30 and the base 32. The crotch 34 is the space where the neck of a user is received, the crotch 34 is configured to receive the neck of a user sufficiently closely to hold the pillow body 20 in position while the user is sitting in repose. The compact size of the travel pillow 10 rests on a user's shoulders, without draping down the front or back of the user's body.

Figure 2:
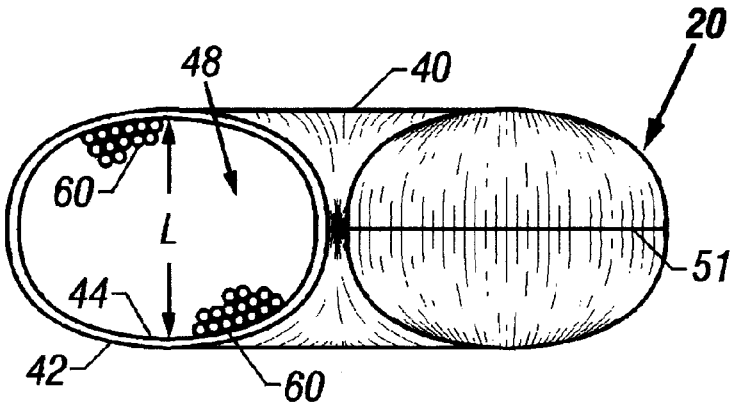
FIG. 2 is a combination cross sectional and front elevation view of the pillow body of the present invention.

As shown in FIG. 2, the pillow body 20 comprises a casing 40 and fill material 60. In the embodiment shown, the fill material 60 is a fluent solid material such as Styrofoam beads. The casing 40 has an exterior surface 42 that defines the exterior surface of the pillow body 20. The interior surface 44 of the casing 40 defines the interior space or lumen 48 of the pillow body 20. The lumen 48 is a single, continuous compartment without partition which contains a fill material 60. When the lumen 48 is substantially filled with a fill material 60, the pillow body has a relatively uniform cross section, as indicated by the length L shown in FIG. 2. The fill material 60 is a solid as opposed to a gas.

Figure 3A:
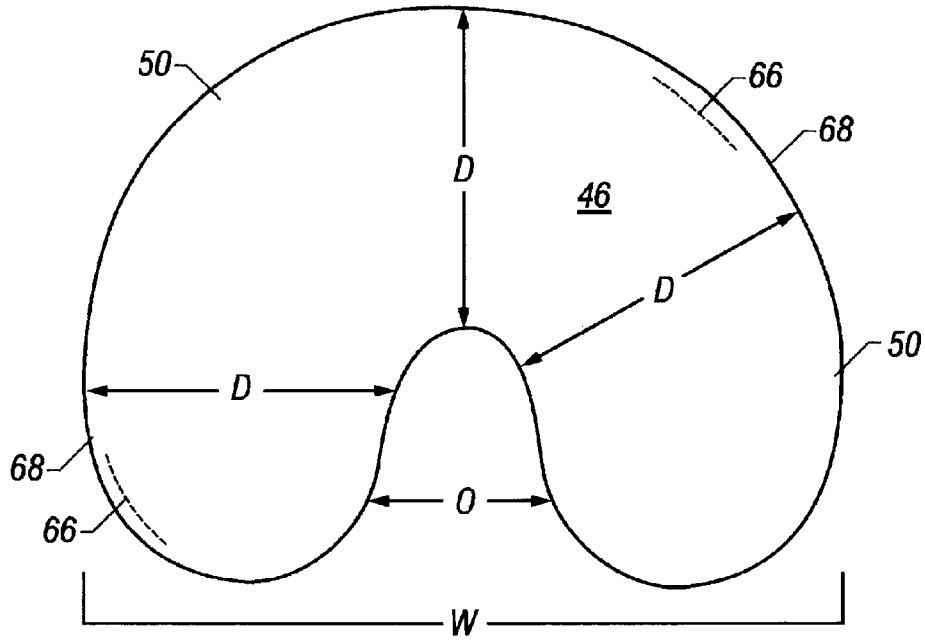
FIG. 3A is a top plan view of a casing fabric member.
Figure 3B:
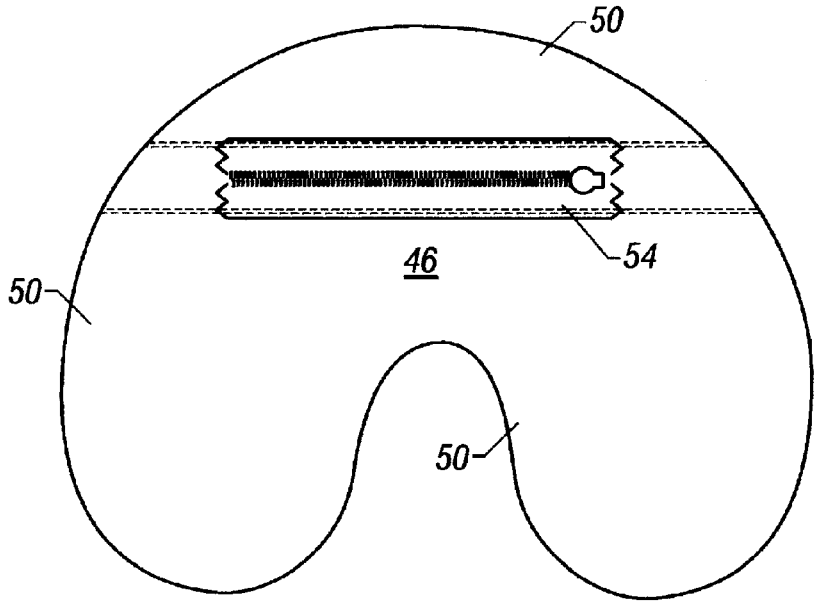
FIG. 3B is a bottom plan view of a casing fabric member showing a zippered opening set into the fabric member.

As shown in FIGS. 3A and 3B, the casing is constructed of two horseshoe or U-shaped fabric members 46 of substantially the same size. The casing fabric members 46 preferably are constructed of washable, woven or knitted material. Materials suitable for practicing the fabric members 46 of the casing 40 include man-made fibers, natural fibers, and combinations thereof, further including cottons, poly/cottons, fleeces, wools, flannels, etc. Each casing fabric member 46 has a perimeter edge 50. The two fabric members 46 contact each other and are secured together by a seam 51 (See FIGS. 1 and 2) around their perimeter edges 50. The seam 51 preferably is sewn together. However, other means for securing the perimeter edges of the fabric members 46 to form a seam 51 are known to and practicable by the ordinary skilled artisan, such as heating or glueing.

As shown in FIG. 3B, one of the fabric casing members 46 has an opening or passage 52 through it. The opening 52 enables access to the lumen 48 of the pillow body 20, after the casing 40 is constructed from the casing fabric members 46. The opening 52 is set into the fabric member 46 at a location away from its perimeter edge 50. The opening 52 is linear and preferably located along a cord of the larger curve of the base 32 of the U-shape of the fabric member 46. It also is preferred that the opening 52 is reversibly closeable. This feature permits a user to add or remove fill material to or from the lumen 48 of the pillow body 20. This enables a user to adjust the firmness of the travel pillow 10 by adding or removing fill material 60 to or from the lumen 48 of the pillow body 20 through the casing opening 52. To accomplish this feature, the casing opening 52 further comprises a reversible closure device 54, which in the preferred embodiment of the figures is a zipper. However, other closure devices 54 are known to and practicable by one of ordinary skill in the art, including button or snap closures, hook-and-loop fasteners, laces, etc. Also, the casing opening 52 and the closure device 54 preferably are covered by a fly 56. The fly 56 is preferably constructed of the same fabric or material as the casing fabric member 46. A pillow cover (not shown) may also be included with the device to extend the period between cleaning of the pillow body as appropriate.

The interior space or lumen 48 of the pillow body 20 is a single, continuous interior compartment for containing the fill material 60. The single, continuous compartment nature of the lumen 48 allows a degree of malleability or sculpability of the travel pillow 10 when it contains a fluent fill material 60 such as polystyrene or plastic beads, or bubbles.

The fill material 60 can be any of a variety of fibrous or fluent solid materials as noted above. It is preferable that the fill material 60 be biologically inert to reduce the opportunity for the growth of germs, molds, mildew, fungi or the like. Appropriate biologically inert fill materials 60 can include polystyrene, polyester, nylon, and similar man-made materials. Additionally it is preferred that the fill material 60 be washable and replaceable by the user. It is intended that the fill material 60 be washable in situ in the casing 40. This enables the travel pillow 10 to be washable as a unit. Alternatively, the user may remove the fill material 60 from the casing 40 and wash them separately. To facilitate removing and replacing the fill material 60, it may be separately contained in a porous sack or bag (not shown).

Figure 4A:
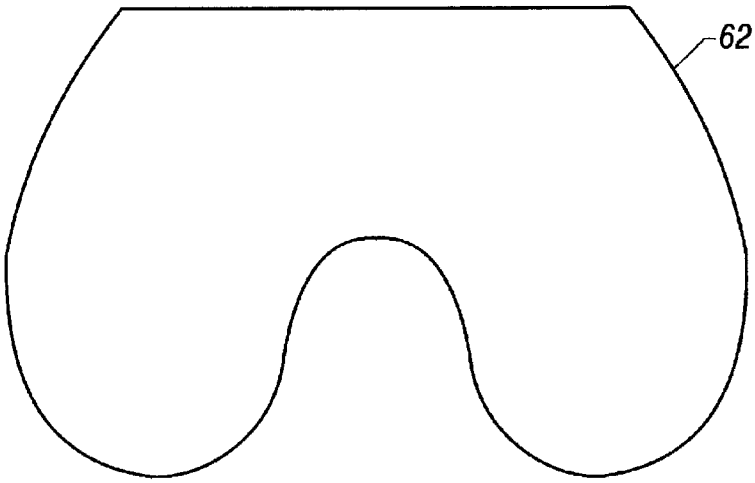
FIGS. 4A and 4B are top plan views of two fabric pattern pieces that may be combined to accomplish a casing fabric member with a closeable opening.
Figure 4B:
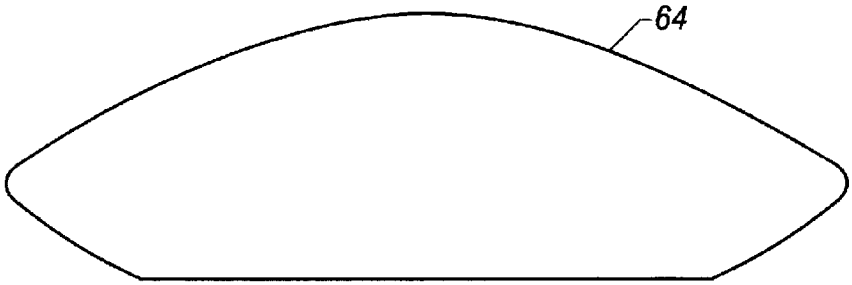
Figure 5:
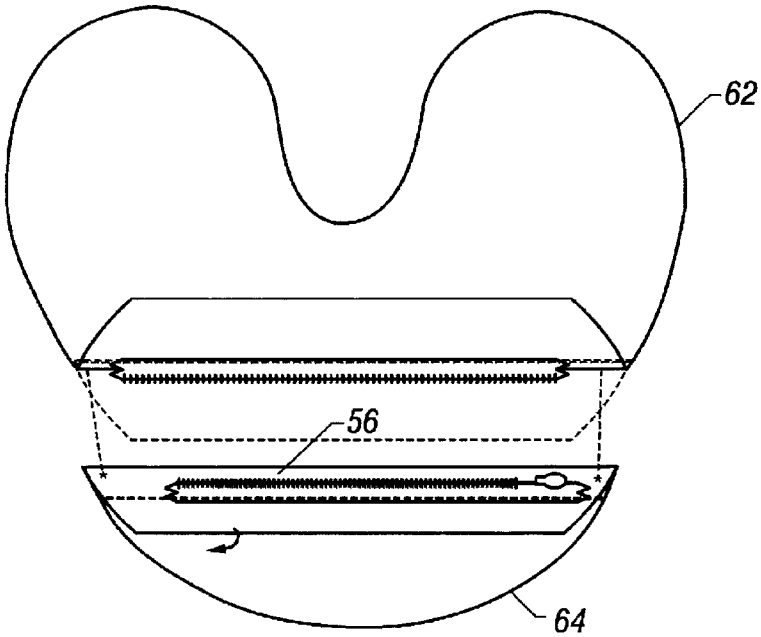
FIG. 5 is a top plan view showing an example of how the two fabric pattern pieces of FIGS. 4A and 4B may be fitted with a zipper and combined to accomplish a casing fabric member having a closeable opening.

FIGS. 4A and 4B illustrate an example of how a casing fabric member 46 may be constructed from two fabric pattern pieces, one being the major pattern piece 62, and the other being the minor pattern piece 64. In the embodiment shown in FIGS. 4A and 4B, the minor pattern piece 64 provides for the fly 56 covering the casing opening 52 of the pillow body 20. However, by shifting the placement of the closure device 54, the major pattern piece 62 can be made to provide the fly 56, and the fly opening would face in the opposite direction from that shown in FIG. 1. A hook-and-loop type fastener such as VELCRO may also be used as a closure device 54, especially where the fill material 60 is fibrous or is separately contained as noted above.

In a preferred embodiment as shown in FIG. 3A, a casing member is constructed from a fleece-like material such as POLARFLEECE. The casing member has an over all width W. The width W ranges from about fourteen to twenty inches, depending on how large a potential cross section length L is desired. The crotch space 54 of the fabric member 46 has an entrance O of about four inches. The base 32 portion of the fabric member 46 has a depth D ranging about five to nine inches. The depth D is substantially uniform around the curvature of the base 32 section of the fabric member 46 as shown in FIG. 3A.

In a preferred embodiment, for a normal adult, the width W is about eighteen inches, the depth D is about seven and one half inches and the entrance O is about four inches. In this embodiment, the seam 51 is sewn on a stitch line 66 about one quarter inch from the edge 68 of the perimeter 50 of the fabric member 46.

While the above description contains many specifics, these should not be construed as limitations on the scope of the invention, but rather as exemplifications of one or another preferred embodiment thereof. Many other variation are possible, which would be obvious to one skilled in the art. Accordingly, the scope of the invention should be determined by the scope of the appended claims and their equivalents, and not just by the embodiments.

What is claimed is:

1. A travel pillow of adjustable firmness and compact size for cradling the neck and head of a user comprising: a pillow body, the pillow body being a casing made of two U-shaped fabric members, substantially similar in size and shape with each member having a perimeter edge wherein one of the members has a closeable opening removed from the perimeter edge of the member, and containing a fill material, and configured in a U-shape and having a substantially uniform cross section around the U-shape of the body, the U-shape having a crotch formed by the joining of two legs, configured to receive the neck of a user sufficiently closely to hold the pillow body in position, and the closeable opening covered by a fly, the opening for adding or removing fill material.

2. The casing of claim 1, wherein the opening is closeable by a zipper.

3. The travel pillow of claim 1, wherein the pillow body further comprises the lumen of the casing being a single, continuous interior compartment filled with a fill material to provide the substantially uniform cross section around the U-shape of the pillow body.

4. The travel pillow of claim 1, wherein the pillow body further comprises the lumen of the casing being a single, continuous interior compartment filled with a biologically inert fill material.

5. The pillow body of claim 4, further comprising the lumen of the casing being filled with a biologically inert fill material that is a man-made material.

6. The pillow body of claim 4, further comprising the lumen of the casing being filled with a biologically inert fill material that is a man-made material selected from the group consisting of polystyrene, polyester, nylon and plastic.

7. The travel pillow of claim 1, wherein the pillow body further comprises a casing that is washable.

8. The casing of claim 1, wherein the two fabric members are connected to each other by means of a seam around their perimeter edges.

9. The travel pillow of claim 1, wherein the pillow body is constructed with a material selected from the group consisting of woven fabrics, knitted fabrics, and fleece-like materials.

10. The travel pillow of claim 1, wherein the pillow body is washable.

11. The travel pillow of claim 1, further comprising a pillow covering for containing the pillow body.

* * * * *